US009394754B2

(12) United States Patent
Kleppa et al.

(10) Patent No.: US 9,394,754 B2
(45) Date of Patent: Jul. 19, 2016

(54) KICK OVER TOOL

(75) Inventors: Erling Kleppa, Jørpeland (NO); Ståle Pettersen, Sandnes (NO)

(73) Assignee: PETROLEUM TECHNOLOGY COMPANY AS, Stavanger (NO)

( * ) Notice: Subject to any disclaimer, the term of this patent is extended or adjusted under 35 U.S.C. 154(b) by 599 days.

(21) Appl. No.: 13/513,200

(22) PCT Filed: Dec. 7, 2010

(86) PCT No.: PCT/NO2010/000450

§ 371 (c)(1),
(2), (4) Date: Aug. 16, 2012

(87) PCT Pub. No.: WO2011/071391

PCT Pub. Date: Jun. 16, 2011

(65) Prior Publication Data

US 2013/0025845 A1 Jan. 31, 2013

(30) Foreign Application Priority Data

Dec. 7, 2009 (NO) ..... 20093485

(51) Int. Cl.
*E21B 23/03* (2006.01)

(52) U.S. Cl.
CPC ..... *E21B 23/03* (2013.01)

(58) Field of Classification Search
CPC ..... E21B 23/03
USPC ..... 166/117.5, 65.1, 372, 313, 50
See application file for complete search history.

(56) References Cited

U.S. PATENT DOCUMENTS

| | | | | | |
|---|---|---|---|---|---|
| 1,747,398 | A | * | 2/1930 | Short | 166/63 |
| 3,401,988 | A | * | 9/1968 | Pingree | 166/241.1 |
| 3,561,528 | A | * | 2/1971 | Butler et al. | 166/117.5 |
| 3,732,928 | A | | 5/1973 | Sizer | |
| 3,752,231 | A | | 8/1973 | McGowen et al. | |
| 3,874,445 | A | * | 4/1975 | Terral | 166/117.5 |
| 3,889,748 | A | * | 6/1975 | Tausch | 166/117.5 |
| 3,899,025 | A | * | 8/1975 | Dinning | 166/117.5 |
| 4,039,026 | A | | 8/1977 | Yonker | |
| 4,294,313 | A | | 10/1981 | Schwegman | |
| 4,375,237 | A | | 3/1983 | Churchman | |
| 4,624,309 | A | * | 11/1986 | Schnatzmeyer | 166/66 |
| 4,744,415 | A | * | 5/1988 | Crawford et al. | 166/117.5 |
| 4,976,314 | A | | 12/1990 | Crawford | |
| 2004/0060694 | A1 | | 4/2004 | Schraub | |
| 2007/0267200 | A1 | * | 11/2007 | Jackson et al. | 166/386 |
| 2009/0056954 | A1 | * | 3/2009 | Arumugam et al. | 166/386 |
| 2009/0229831 | A1 | * | 9/2009 | Zupanick | 166/372 |

FOREIGN PATENT DOCUMENTS

| | | | | | |
|---|---|---|---|---|---|
| NO | WO 2008118022 | A1 | * | 10/2008 | E21B 23/03 |
| WO | WO 98/26154 | A | | 6/1998 | |

* cited by examiner

*Primary Examiner* — Nicole Coy
*Assistant Examiner* — Tara Schimpf
(74) *Attorney, Agent, or Firm* — Birch, Stewart, Kolasch & Birch LLP

(57) ABSTRACT

The present invention relates to a kick over tool (5) for manipulating and installing devices into and removing devices from a side pocket mandrel (2), where the kick over tool is designed to enable multiple operations in the same run. The kick over tool comprises a tubular carrier housing (6) adapted for passage through a full opening bore of a production string, at least a first and second setting device (8,9) that is arranged in said carrier housing, the first and second setting device being pivotally connected to a first and second articulated linkage mechanism (12,13) comprising a coupling device for the well bore device.

9 Claims, 2 Drawing Sheets

Fig.3a.
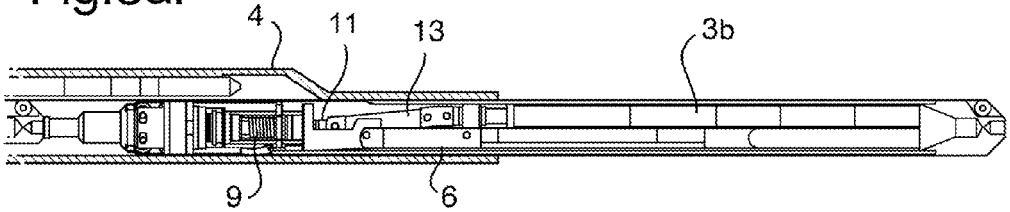
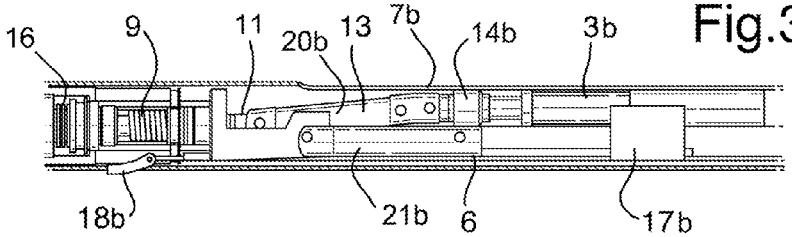
Fig.3b.
Fig.4a.
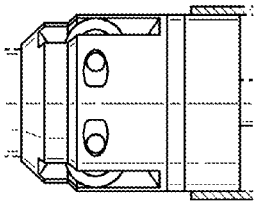
Fig.4b.
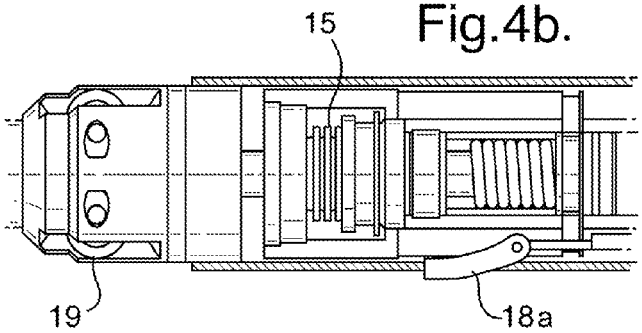

KICK OVER TOOL

FIELD OF THE INVENTION

The present invention generally relates to an apparatus for manipulating an eccentrically located well bore device. More particularly, the present invention relates to a kick over tool for manipulating and installing well bore devices into and removing devices from a side pocket mandrel, where the kick over tool is designed to enable multiple operations in the same run.

BACKGROUND OF THE INVENTION

A well bore device according to the present invention should be understood as different tools, equipment and/or instruments that are used in connection with oil relating work, in order to perform different operations.

In producing hydrocarbons, including water, oil and oil with entrained gas, from a geological formation, natural pressure in a reservoir acts to lift the produced medium upwards to a surface through a production tubing. The reservoir pressure must exceed the hydrostatic pressure of the fluid in the well bore and back-pressure imposed by the production facilities at the surface of the well to produce naturally. This is not always the case and one sometimes needs to assist the production flow to get it out of the production tubing.

For instance, if the natural pressure in the reservoir has dropped so much that the natural flow of liquid from the well has ceased or become too slow for economical production, artificial production methods are employed. Several artificial production systems and/or methods are known, where a fluid medium is injected into the production tubing. The fluid medium can be gas, liquid, processed well fluid or even a part of the well fluid from the reservoir. The two most commonly used systems today are water and gas injection.

In many cases, it is advantageous, at least during the first part of the artificial production period, to employ so-called Artificial gas lift. Natural gas, which is recovered from a reservoir, is treated and compressed, before it is rerouted and injected into a space (annulus) between a casing of the well and the production tubing and injected into the well fluid in the production tubing. As the well liquid in the production tubing becomes mixed with the injected natural gas, the density of the well liquid decreases, whereby the well liquid in the production tubing will be "lifted" towards the surface of the well.

The natural gas is injected through one or more gas lift valves arranged along the length of the production tubing, where the number of gas lift valves will depend on the needs in the field or well. The gas lift valves are usually arranged in side pocket mandrels forming a part of the production tubing, where a kick over tool is used to place and replace the gas lift valves in the side pocket mandrels.

From WO 98/26154 is known a kick over tool for use with a side pocket mandrel for positioning an elongated well tool instrument in an offset side pocket bore, where the kick over tool has a setting tool connected to a linkage mechanism normally held in a rigid straight line condition within a carrier housing. The kick over tool is orientated inside a side pocket mandrel and activated to pivotally extend the terminal end of the elongated well tool instrument into contact with the wall of a side pocket mandrel in vertical alignment with a side pocket bore. When the well tool instrument is lowered into the side pocket bore, the linkage mechanism is released from a straight line condition to align the well tool parallel to the carrier housing for insertion of the well tool in the side pocket bore. The well tool is released from the kick over tool when in the side pocket bore and the linkage mechanism is retracted into the carrier housing for retrieval.

U.S. Pat. No. 3,752,231 describes a flow control unit handling apparatus adapted for use in placing a flow control unit in a selected offset set in a well tubing mandrel and for removing said unit therefrom. An elongated housing adapted to support a flow control unit and pivotally connected at its upper end to a supporting means for raising and lowering the housing in the well tubing and an elongated protective guide means pivotally supported from the housing allowing the apparatus to pass freely downwardly through an offset mandrel. The apparatus also comprises a key for locating, positioning and tripping the apparatus into position to allow a valve to be placed or pulled from a selected offset seat.

However, due to the structure of known kick over tools, the kick over tool has to be retrieved from the production tubing after each performed operation, as the kick over tools are not designed to perform more than one operation at a time. This results in, for instance if a gas lift valve arranged in a side pocket mandrel should be replaced with a new gas lift valve, the kick over tool must first be run down the production tubing to retrieve the old gas lift valve, whereafter the kick over tool must be pulled out of the production tubing, the old gas lift valve removed, the new gas lift valve installed in the kick over tool and the kick over tool once again run down the production tubing, where the new gas lift valve is installed in the side pocket mandrel. As a result, it takes a lot longer to perform the desired operation and there is a greater chance that something may go wrong. Furthermore, in the known kick over tools, one disadvantage has been that the arms that hold the gas lift valve are not always able to align the gas lift valve with the side pocket bore of the side pocket mandrel, whereby the gas lift valve may be damaged during the installation in the side pocket bore.

BRIEF SUMMARY OF THE INVENTION

Accordingly, it is an object of the present invention to provide a kick over tool that can both install and retrieve new or existing well bore devices in a laterally offset side pocket of a side pocket mandrel in the same run. It is also an object of the present invention to provide a kick over tool where the well bore devices are aligned to the laterally offset side pocket of the side pocket mandrel, in order to prevent damage of the well bore devices during the installation of a well bore device.

It is a further object of the present invention to provide a kick over tool provided with at least two operation performing devices, where only one operational device is activated at any given time, while the second operational device will remain in a passive state.

It is a further object of the present invention to provide a kick over tool that will not allow one operation to be finished unless it is confirmed with a positive indication that the operation is completed.

One further object of the present invention is to provide a kick over tool that in addition to installing and/or retrieving the well bore devices also can perform service inside the side pocket mandrel/laterally offset side pocket.

These objectives are achieved, with a mandrel according to the present invention as defined in the enclosed independent claims, where embodiments of the invention are given in independent claims.

The present invention generally relates to an apparatus for manipulating an eccentrically located well bore device. More particularly, the present invention relates to a kick over tool for manipulating and installing well bore devices into and removing devices from a side pocket mandrel, where the kick over tool is designed to enable multiple operations in the same run.

The present invention regards a kick over tool for use in a well bore, where the well bore contains a production tubing with a side pocket mandrel. The kick over tool is comprised of a tubular carrier housing adapted for passage through a full opening bore of the production tubing, where at least a first and second setting device is arranged in the carrier housing, the first and second setting devices being pivotally connected to a corresponding first and second pivotal and articulated linkage mechanism comprising a coupling device for the well bore devices, the activation of the second setting device being dependent on detection of attachment of a well bore device to the coupling device of the first articulated linkage mechanism, as a plurality of sensors or detectors are arranged in the vicinity of the first articulated linkage system.

In one preferred embodiment of the present invention the kick over tool (i.e. the tubular carrier housing) will be comprised of one part, but is should be understood that the kick over tool can also be comprised of several parts. This can, for instance, be the case when the kick over tool is to be used in a deviated well. The different parts of the kick over tool can then be hinged or connected to each other in another way, allowing a certain bending of the kick over tool.

As the pivotally and articulated linkage mechanisms are operated between a retracted position inside the kick over tool and an extended position outside the kick over tool, the tubular carrier housing is provided with a plurality of recesses or cut outs over its length. The pivotally and articulated linkage mechanisms are then arranged in these recesses or cut outs, such that they can be extended outside the kick over tools through these recesses or cut outs.

The setting devices of the kick over tool can be operated in different ways, for instance hydraulically, electrically or mechanically, where the setting devices preferably are operated in the same way. However, the setting devices may also be operated in different way. For instance, one of the setting devices may be operated hydraulically, while the other is operated electrically.

Furthermore, each of the setting devices is connected to an activation mechanism.

In order to obtain a correct and secure orientation of the well bore device in the side pocket bore of the side pocket mandrel, each of the two linkage mechanisms preferably comprises at least two parallel and pivotally connected arm members. The arm members can be designed in different ways, but are preferably plate members being arranged parallel beside each other. At least one of the arm members is then pivotally connected through one end to an inside of the tubular carrier housing of the kick over tool, and the at least one other arm member is connected through one end to a movable rod of the setting device. Opposite ends of the at least two arm members are pivotally connected to the coupling device for the well bore devices. The arm members will, due to this, be comprised of different lengths, where the at least one arm member being connected to the tubular carrier housing will be of shortest length. This will result in that the orientation or alignment of the well bore device, when the well bore device is to be inserted in the offset side pocket bore of the side pocket mandrel, will be mainly parallel with the offset side pocket bore, whereby damage of the well bore device (sealing assemblies etc.) during the installation is prevented.

Furthermore, while the kick over tool is run inside and down the production tubing, it may be rotated, whereby the kick over tool must be orientated correctly in relation to the offset side pocket bore of the side pocket in order to be able to perform the desired operations. The kick over tool is therefore provided with one or more guiding taps, where these guiding taps will cooperate with a guiding track inside the side pocket mandrel. This arrangement will rotate the kick over tool in order to arrange the setting devices above the offset side pocket bore. In one preferred embodiment the kick over tool is provided with two guiding taps, where one tap is assigned each of the first and second setting devices.

At least one of the arm members may also be connected to resilient means, for instance a spring or the like, where this will ease the operation of the linkage mechanism.

As the kick over tool will have a diameter that is smaller than a diameter of the production tubing, the kick over tool is preferably provided with at least one means to centre the kick over tool in the production tubing. The means to centre may for instance be a plurality of wheels, guides, centralizers etc., where these are arranged around the periphery and length of the kick over tool. The means to centre are preferably adjustable, so that they can be adjusted from a retracted and inactive position and to an extended and active position. This arrangement will in addition to centering the kick over tool, also prevent rotation of the kick over tool when the kick over tool performs the desired operations in the side pocket mandrel. The means centering may be operated in different ways, for instance electrically.

One or more sensors or detectors are arranged inside the tubular carrier housing of the kick over tool, where the sensors or detectors are placed in the vicinity of each and one of the pivotally and articulated linkage mechanisms. The sensors or detectors are also connected with each other and with the setting devices, in such a way that the second setting device cannot be activated before the first setting device has positively performed its operation. The sensors or detectors that are located in the vicinity of the first pivotally and articulated linkage mechanism will then be able to detect, for instance when an old well bore device is retrieved from the side pocket bore, that the well bore device is attached and retrieved from the side pocket bore, whereby the sensors or detectors will send a signal to the sensors or detectors that are connected to the second setting device, in order to activate the second setting device.

Furthermore, in a preferred embodiment of the present invention the sensors or detectors are also connected to the guiding taps, where the activation or deactivation of the different guiding taps will be dependent on which state the first and second setting devices are in.

BRIEF DESCRIPTION OF THE DRAWINGS

The novel features of the present invention, as well as the invention itself, will be best understood from the attached drawings, together with the following description, to which similar reference characters refer to similar parts, and in which:

FIGS. 3*a* and 3*b* shows the operation of a second articulated linkage mechanism, where a well bore device is installed in the side pocket mandrel (only a part of the kick over tool is shown), FIGS. 4*a* and 4*b* shows details of a part of the kick over tool.

The present invention regards a kick over tool for removing devices and removing well bore devices from a side pocket mandrel that is part of a production tubing. The kick over tool may be utilized to install and retrieve well bore devices (down hole devices), and particularly valves, such as gas lift valves, relief valves, water flood valves and steam injection valves which are positioned in the side pocket mandrel.

However, the kick over tool may also be utilized to install and retrieve other well bore devices, such as different plugs, temperature and pressure sensors, flow measurements devices etc. In addition, the kick over tool may also comprises equipment and/or tools for servicing and maintaining inside the side pocket mandrel and/or offset side pocket bore.

Figure 1:
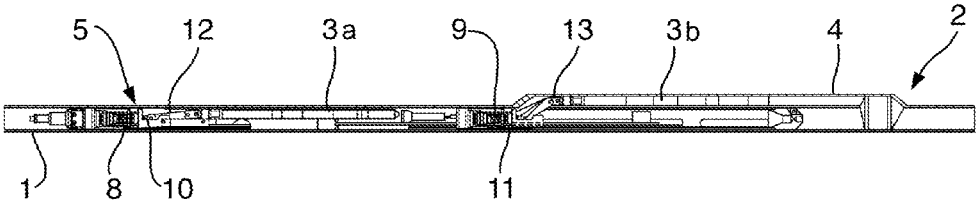
FIG. 1 is a sectional and schematic view of one embodiment of a kick over tool according to the present invention.
Figure 5:
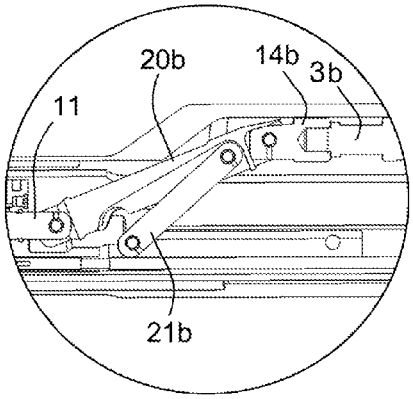
FIG. 5 shows details of part of the kick over tool according to FIG. 1.

FIG. 1 shows part of a production tubing 1 comprising a side pocket mandrel 2, where a well bore device 3 is fixed in a laterally offset side pocket bore 4 of the side pocket mandrel 2. A kick over tool 5 according to the present invention is connected to a conveyance member (e.g. a wire line or tractor, not shown), which controls the position of the kick over tool 5 from the surface of the well.

The kick over tool 5 comprises a tubular carrier housing 6, where the tubular carrier housing 6 over a part of its length is provided with at least one cut out or a recess 7*a*, 7*b* (see FIGS. 2*a*-2*c* and FIGS. 3*a* and 3*b*), in order to permit operation of the kick over tool 5. Inside the tubular carrier housing 6 are arranged a first and second setting device 8, 9, where the first and second setting devices 8, 9 through respective stems/rods 10, 11 are connected to a first and second pivotally and articulated linkage mechanisms 12, 13 (first setting device 8 being connected to first pivotally and articulated linkage mechanism 12, and second setting device 9 being connected to second pivotally and articulated linkage mechanism 13) Each of the first and second pivotally and articulated linkage mechanisms 12, 13 is then arranged in the vicinity of the cut out or recess 7*a*, 7*b*, whereby the pivotally and articulated linkage mechanisms 12, 13 are brought out of the recesses or cut outs 7*a*, 7*b* when they are to perform an operation.

Each of the pivotally and articulated linkage mechanisms 12, 13 comprises a first arm member 20*a*, 20*b* and second arm member 21*a*, 21*b*, where an end of the first arm member 20*a*, 20*b* is pivotally connected to the rod/stem 10, 11 of the first and second setting devices 8, 9, and an end of the second arm member 21*a*, 21*b* is pivotally connected to an inside of the tubular carrier housing 6. The opposite ends of the first and second arm members 20*a*, 20*b*, 21*a*, 21*b* are pivotally connected to a coupling device 14*a*, 14*b* for the well bore device 3*a*, 3*b*.

The coupling device 14*a*, 14*b* for the well bore device 3*a*, 3*b* comprises fastening and releasing means in order to be able to maintain the well bore device 3*a*, 3*b* until the well bore device 3*a*, 3*b* is to be released, whereafter the coupling device 14*a*, 14*b* can be released from the well bore device 3*a*, 3*b*.

The first and second setting devices 8, 9 comprise a hydraulic arrangement. Each of the first and second setting devices 8, 9 is connected to an activation mechanism 15, 16. When for instance the activation mechanism 15 gives a signal to the first setting device 8, the stem/rod 10 will be moved in the longitudinal direction of the kick over tool 5, whereby the first pivotally and articulated linkage mechanism 12 can be brought from an inactive position inside the tubular carrier housing 6 and to an extended position outside the tubular carrier housing 6, in order to perform an operation, and vice versa.

At each linkage mechanism 12, 13, a sensor or detector 17*a*, 17*b* is arranged inside the tubular carrier housing 6, where the sensor or detector 17*a*, 17*b* is located such that it can detect presence of the well bore device 3*a*, 3*b*. The sensor or detector 17*a* is further connected to the activation mechanism 16 of the second setting device 9, such that the second setting device 9 cannot be activated before the sensor or detector 17*a* has detected that well bore device 3*a* has been retrieved from the side pocket bore of the side pocket mandrel.

The kick over tool 5 also comprises taps 18*a*, 18*b*, where one tap 18*a*, 18*b* is assigned each of the first and second setting devices 8, 9. The tap 18*a*, 18*b* is used to orientate and rotate the kick over tool in the production tubing, as the production tubing on its inside is provided with a guiding track (not shown). Furthermore, the tap 18*a*, 18*b* is also connected to the sensor or detector 17*a*, 17*b*, such that the tap 18*a*, 18*b* will remain in a position outside the kick over tool as long as the sensor or detector 17*a*, 17*b* has not positively detected that the well bore device 3*a*, 3*b* is retrieved. This will prevent that the kick over tool can be retracted from the production tubing before the desired operation is performed. Once the sensor or detector 17 has a positive identification of the well bore device 3, the tap 18 will be retracted into the kick over tool 5.

Figure 2A:
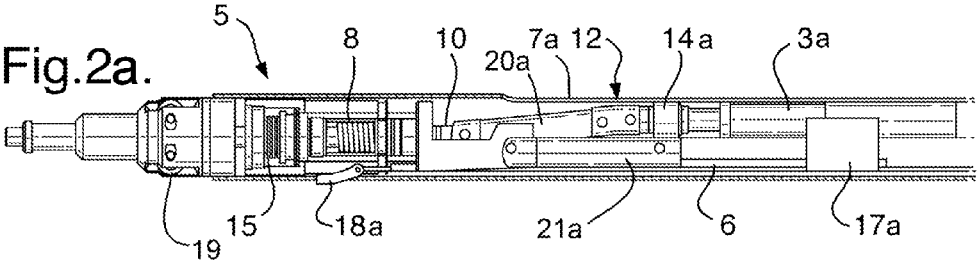
FIGS. 2*a*-2*c* shows the operation of a first articulated linkage mechanism, where a well bore device is retrieved from a side pocket mandrel (only a part of the kick over tool is shown)
Figure 2B:
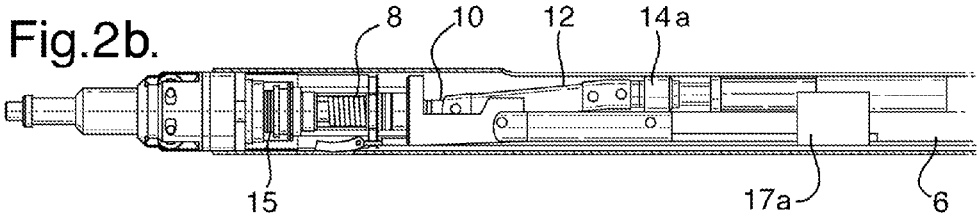
Figure 2C:
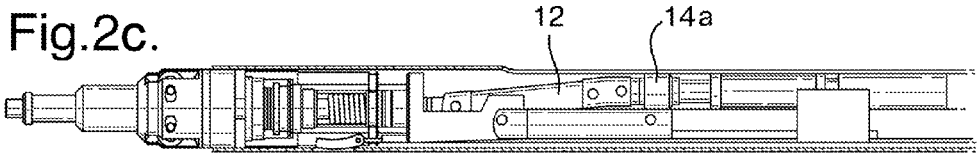

FIGS. 2*a*-2*c* shows how the kick over tool 5 perform an operation, where the kick over tool 5 is used to retrieve and change a well bore device 3*a*, 3*b* from a side pocket mandrel. FIGS. 2*a*-2*c* shows only a first half of the kick over tool 5, in which half the first setting device 8 and the first pivotally and articulated linkage mechanism 12 are arranged. Upon orientation of the kick over tool 5 in the side pocket mandrel 2, the activation device 15 is activated, whereby the first setting device 8 has manipulated the first pivotally and articulated linkage mechanism 12 outside the tubular carrier housing 6. The first pivotally and articulated linkage mechanism 12 has thereafter, through the coupling device 14 been connected to the well bore device 3*a*, and is shown while it is operated towards the inactive position. When the first pivotally and articulated linkage mechanism 12 is brought into the tubular carrier housing 6, the well device 3*a* will be brought into contact with a sensor or detector 17*a*, whereby the sensor or detector can "confirm" that the well bore device 3*a* has been retrieved from the offset side pocket bore. This confirmation will send a signal to the tap 18*a* of the first setting device, such that this tap 18*a* is refracted inside the kick over tool 5. The kick over tool 5 can then be pulled a length or distance axially inside the side pocket mandrel 2, such that the second pivotal and articulated linkage mechanism 13 can be used to install a new well bore device 3*b* inside the offset side pocket bore of the side pocket mandrel 2. In addition, a signal is also sent to the activation device 15 of the second setting device 9, in order to manipulate the second pivotal and articulated linkage mechanism 13.

This is shown in FIGS. 3*a* and 3*b*, where a second half of the kick over tool 5 is shown, in which second half the second setting device 9 and the second pivotally and articulated linkage mechanism 13 are arranged. The second setting device 9 will then manipulate the second pivotal and articulated linkage mechanism 13 from a retracted position inside the tubular carrier housing 6 to an extended position outside the tubular carrier housing 6, whereby the new well bore device 3*b* can be installed inside the offset side pocket bore. When the new well bore device is arranged and in an appropriate way fastened inside the offset side pocket bore, the connection between the well bore device 3*b* and the coupling device 14*b* of the second pivotal and articulated linkage mechanism 13 is sheared and the second pivotal and articulated linkage mechanism 13 can be brought back into a retracted position inside the tubular carrier housing 6.

Through the above described arrangement of the kick over tool is provided a kick over tool which will allow multiple operations in the same run and where only one device is activated at any given time, the other being inactive. Furthermore, the inactive device will not be activated until a positive "confirmation" of an operation performed by the activated device is made.

FIGS. 4*a* and 4*b* shows means for centering the kick over tool 5 in the production tubing, where a plurality of wheels 19 are arranged in front and around the periphery of the kick over tool 5. The wheels 19 are adjustable from an inactive position, being retracted into the kick over tool, and to an active position (not shown), being extended out of the kick over tool 5.

Although the invention has been described in relation to its preferred embodiments, it will be apparent to those skilled in the art that variations may be applied to what has been described herein without departing from the principles of the concept, script and scope of the present invention. All such similar substitutes and modifications apparent to those skilled in the art are deemed to be within the spirit, scope and concept of the present invention as it is set out in the following claims.

The invention claimed is:

1. A kick over tool for use in a well bore, the well bore containing a side pocket mandrel with a laterally offset side pocket with a bore sized for receiving well bore devices, where the kick over tool comprises:

a tubular carrier housing adapted for passage through a full opening bore of a production string, a first setting device arranged in the housing, which first setting device is pivotally connected to a first articulated linkage mechanism via a first stem, which first articulated linkage mechanism comprises a first coupling device for a first well bore device, a second setting device arranged in the housing, which second setting device is pivotally connected to a second articulated linkage mechanism via a second stem, which second articulated linkage mechanism comprises a second coupling device for a second well bore device, and a sensor or detector arranged inside the carrier housing for detecting the retrieval of the first well bore device by the first coupling device, wherein the activation of the second setting device is dependent on the sensor or detector detecting attachment of the first well bore device to the first coupling device, and further wherein the first and the second linkage mechanisms each comprises pivotally connected first and second arm members, wherein the first arm member, at one end, is pivotally connected to the stem and, at the other end, is pivotally and directly connected to the coupling device and the second arm member, at one end, is pivotally and directly connected to the carrier housing and, at the other end, is pivotally connected to the first arm member.

2. Kick over tool according to claim 1, wherein each setting device is connected to an activation mechanism.

3. Kick over tool according to claim 1, wherein the first setting device is hydraulically operated and the second setting device is electrically operated.

4. Kick over tool according to claim 1, wherein the carrier housing is provided with at least two cut outs or recesses over a length of the carrier housing.

5. Kick over tool according to claim 1, wherein the sensor or detector is arranged inside the carrier housing.

6. Kick over tool according to claim 1, wherein a first sensor or detector arranged adjacent to the first articulated linkage mechanism is connected to the first setting device, while a second sensor or detector arranged adjacent to the second articulated linkage mechanism is connected to the second setting device.

7. Kick over tool according to claim 1, wherein a sensor or detector arranged adjacent to the second articulated linkage mechanism is connected to the second setting device.

8. Kick over tool according to claim 1, wherein the kick over tool comprises one or more taps, where the taps remain in an active state until a sensor or detector has positively verified that a well bore device is attached to the coupling device of the first articulated linkage mechanism.

9. Kick over tool according to claim 1, wherein the kick over tool, over its outer periphery and length, is provided with a plurality of wheels and/or centralizers, and wherein the wheels and/or centralizers are provided to be adjustable.

* * * * *